US005288031A

United States Patent [19]

Linderoth

[11] Patent Number: 5,288,031

[45] Date of Patent: Feb. 22, 1994

[54] ARRANGEMENT IN AN AUTOMATIC CABLE WINDING MACHINE

[75] Inventor: Gustaf Linderoth, Enkoping, Sweden

[73] Assignee: Nokia-Maillerfer Holding S.A., Ecublens, Switzerland

[21] Appl. No.: 26,179

[22] Filed: Mar. 1, 1993

Related U.S. Application Data

[63] Continuation of Ser. No. 658,310, Feb. 20, 1991, abandoned.

[30] Foreign Application Priority Data

Mar. 30, 1990 [SE] Sweden ..... 9001179-2

[51] Int. Cl.[5] ..... B65H 75/00

[52] U.S. Cl. ..... 242/54 R; 242/57; 242/68.4

[58] Field of Search ..... 242/54 R, 58.6, 65, 242/66, 68, 79, 57, 75.51, 68.4

[56] References Cited

U.S. PATENT DOCUMENTS

| | | | |
|---|---|---|---|
| 1,742,029 | 12/1929 | Fallot | 242/58.6 |
| 2,984,429 | 5/1961 | Huck | 242/58.6 |
| 3,198,449 | 8/1965 | Scher | 242/54 R |
| 3,334,834 | 8/1967 | Davidson et al. | 242/65 |
| 4,026,486 | 5/1977 | Law | 242/58.6 |
| 4,085,904 | 4/1978 | McElroy | 242/54 R |
| 4,194,702 | 3/1980 | Ploeg | 242/54 R X |
| 4,634,069 | 1/1987 | Kataoka | 242/65 |
| 4,679,743 | 7/1987 | Dallmaier | 242/54 R |
| 4,781,335 | 11/1988 | Compagnon | 242/54 R |
| 4,893,763 | 1/1990 | Wales et al. | 242/58.6 |
| 5,000,394 | 3/1991 | Wales et al. | 242/75.51 X |

*Primary Examiner*—John M. Jillions
*Assistant Examiner*—John P. Darling
*Attorney, Agent, or Firm*—Finnegan, Henderson, Farabow, Garrett & Dunner

[57] ABSTRACT

An arrangement for winding and unwinding a cable on and from a drum, respectively, in an automatic winding machine having two gripping pins connected to a device for displacing the pins vertically between a fixed upper winding position and a lower drum gripping position, and a drive wheel operated by a pressure device and connected to an adjusting device for displacing the wheel to an operating position against the drum flange. In order to fully automate the adjustment of the wheel and the regulation of its pressure in accordance with the size and material of the flange, a detector is provided for detecting the vertical distance of the pin from the floor plane in the gripping position as an indication of flange diameter; and the detector is arranged to control, on the basis of the detected distance, both the adjusting device of the wheel to adjust the drive wheel to an operating position corresponding to the flange diameter, and the pressure device to regulate the pressure of the wheel against the flange with a force corresponding to the flange diameter.

7 Claims, 2 Drawing Sheets

ARRANGEMENT IN AN AUTOMATIC CABLE WINDING MACHINE

This application is a continuation of application Ser. No. 07/658,310 filed Feb. 20, 1991, now abandoned.

BACKGROUND OF THE INVENTION

The present invention relates to an arrangement in an automatic winding machine for winding and unwinding a cable, thread or other similar product on and from a flanged drum, respectively. The winding machine typically includes:

two gripping pins positioned in a support frame vertically displaceably and arranged to coaxially grip one flange of the drum, respectively, and to lift the drum from a floor plane;

a power means for displacing the gripping pins vertically between a fixed upper winding position and a lower gripping position varying in accordance with the diameter of the flange of the drum;

a rotation apparatus supported by the support frame and comprising a displaceable drive wheel and a press means for pressing the drive wheel against the flange of the drum; and an adjusting means for displacing the drive wheel to an operating position against the flange of the drum.

A winding machine of this type is used especially in the cable industry for winding a cable on a drum or for unwinding a cable from a drum, but it is equally applicable for winding other similar products, such as threads and ropes. The winding machine operates in such a manner that the drum is gripped by means of the gripping pins of the winding machine and lifted up from the floor plane to a fixed winding position, whereafter the drum is rotated by means of a rotation apparatus which is pressed against one flange of the drum. One embodiment of this kind of winding machine is disclosed in the U.S. application Ser. No. 07/778,124 and U.S. Pat. No. 4,781,335.

Winding drums used in such winding machines vary in size, that is, their flanges differ in diameter. Therefore it is necessary that the rotation apparatus be displaceable by adjusting means to an appropriate operating position in which the drive wheels of the rotation apparatus contact the periphery of one flange of the drum.

Moreover, winding drums used in such winding machines are made of different materials, such as metal, plastic and wood, wherefore it is necessary that the pressure by which the drive wheel of the rotation apparatus is pressed against the flange of the drum be adjustable to an appropriate value. Large drums normally require a high pressure on account of the thick cable to be wound, whereas small drums normally require a low pressure. An excessive pressure exposes the drive wheel to wear, while an inadequate pressure causes slippage as well as wear. Maximum pressure causes a risk that the drive wheel will break the drum, especially small drums with flanges made of a weaker material.

In prior art winding machines of this type, the drive wheel of the rotation apparatus is adjusted manually to an appropriate distance from the fixed winding position of the gripping pins, or the winding position of the gripping pins is adjusted to an appropriate distance from the fixed operating position of the drive wheel. In both cases, the adjustment is merely approximate, since the accuracy of adjustment is totally dependent on the professional skill and experience of the operator making the adjustments. Prior art winding machines have a single preset pressure value, as a result of which the drive wheel wears down too rapidly, and the drum is liable to damage. Even in cases where manual adjustment of the pressure is possible, the accuracy of adjustment is nevertheless totally dependent on the professional skill and experience of the operator.

SUMMARY OF THE INVENTION

The object of the present invention is to avoid the above-mentioned disadvantages and to provide an arrangement which enables adjustment of the drive wheel and regulation of the pressure fully automatically in accordance with the diameter of the flange of the drum to be used in each particular case. This is achieved by means of an arrangement according to the invention which is characterized in that the winding machine is provided with a means for detecting a vertical distance of one gripping pin from the floor plane in the position for gripping the drum to determine the diameter of the flange of the drum; and that the detecting means is arranged to influence, on the basis of the detected distance, both the adjusting means of the drive wheel to adjust the drive wheel to an operating position corresponding to the diameter of the flange of the drum, and the press means of the rotation apparatus to regulate the pressing of the drive wheel against the flange of the drum with a force corresponding to the diameter of the drum flange.

The invention is based on the idea that the vertical displacing movement of the gripping pins down to the gripping position is utilized to determine the size of the flange of the drum to be used next, and the obtained information is utilized both to adjust the rotation apparatus to an appropriate operating position in view of the size of the drum flange, and to regulate the pressure of the press means to an appropriate value in view of the diameter and material of the drum flange. The invention is especially applicable in winding machines used in the production of cables, where the continuous cable production processes require that the exchange of the drum and the adjustment and regulation operations required for restarting the winding process take place with a minimum of time delay and in such a manner that the size and kind of the drum are taken into account as accurately as possible. The service life of the drive wheel can be increased to a maximum as the pressure of the drive wheel is regulated automatically in accordance with the diameter and material of the drum flange. The invention eliminates all manual adjustment and regulation errors.

BRIEF DESCRIPTION OF THE DRAWINGS

In the following the invention will be described more closely with reference to the attached drawing, in which.

DETAILED DESCRIPTION OF THE INVENTION

Figure 1:
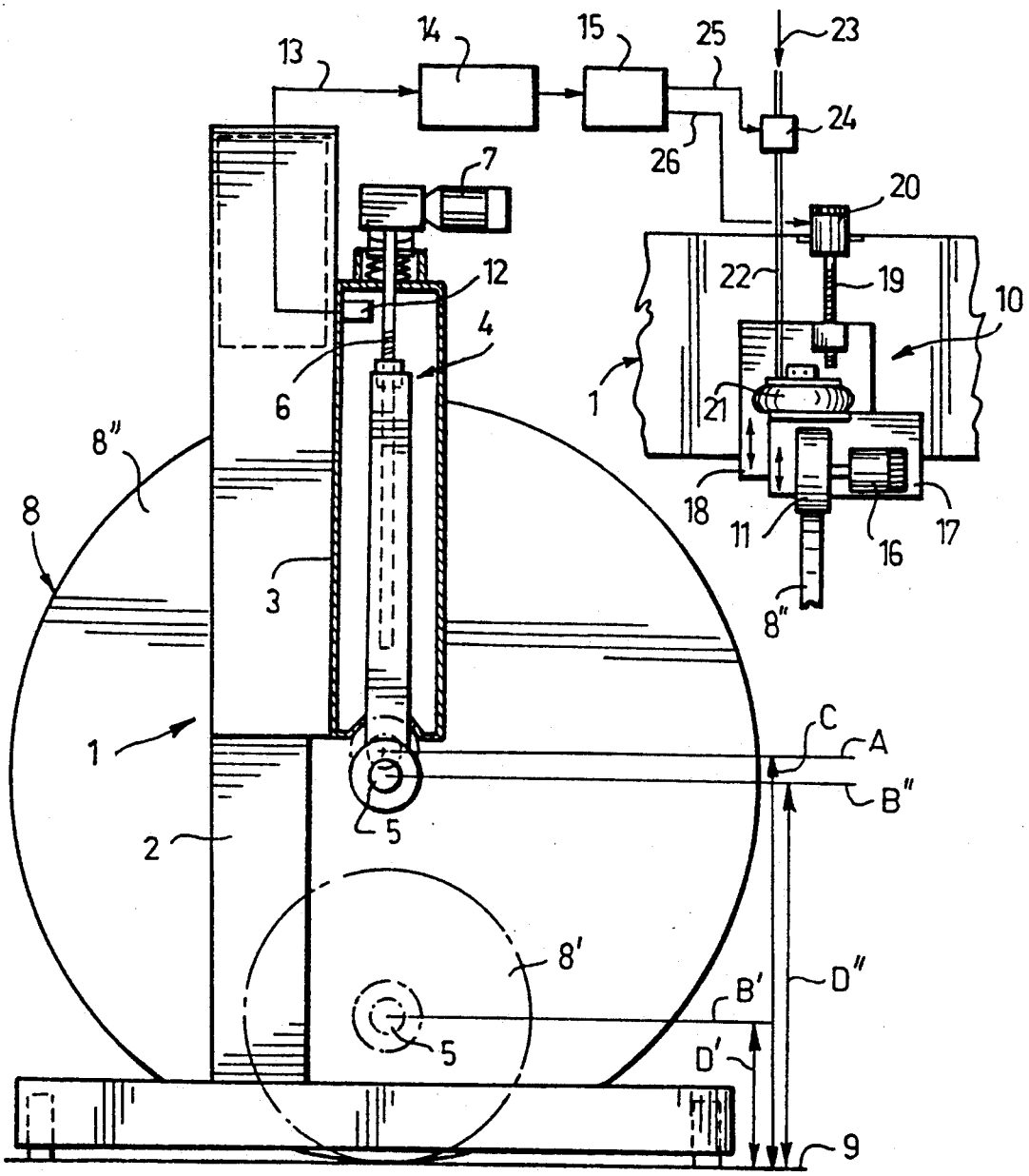
FIG. 1 is a side view of a winding machine provided with an arrangement according to the invention.
Figure 2:
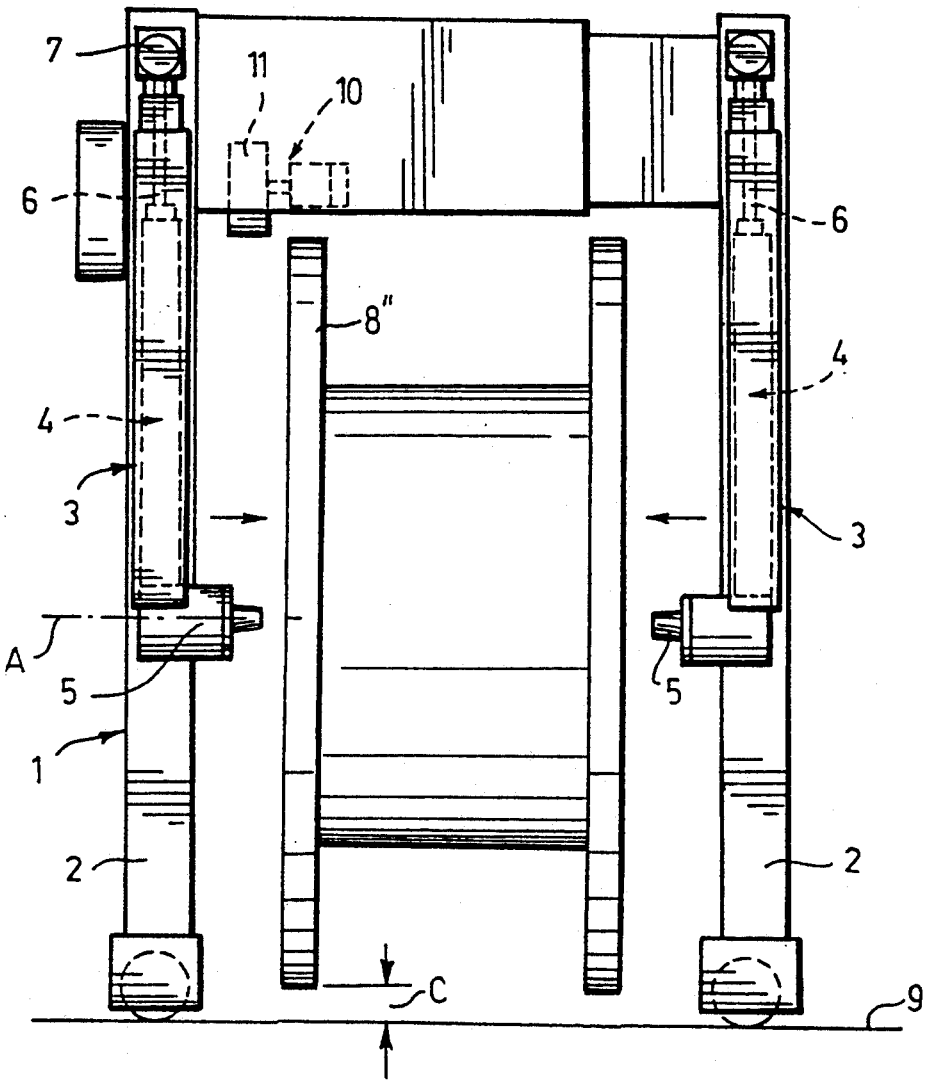
FIG. 2 is a front view of the machine of FIG. 1 showing the operating principle of the arrangement of the invention.

The drawings show a winding machine of the type disclosed in U.S. patent application Ser. No. 778,124.

The winding machine comprises a support frame 1 and two carriers 3 supported vertically stationary by the columns 2 of the support frame. Each carrier is provided with a lifting device 4 having a gripping pin 5 mounted vertically displaceably on an adjusting screw 6 mounted vertically stationary but rotatably on the carrier. The adjusting screw is rotatably connected to a motor 7. Each gripping pin is vertically displaceable by means of the adjusting screw between a fixed upper winding position A and a lower gripping position B' or B" in which the gripping pins are inserted into central openings in a drum 8. The position for gripping the smallest drum 8' is indicated with B' while the position for gripping the largest drum 8" is indicated with B". In the winding position the drum is positioned at a distance C above a floor plane 9. In the position B' for gripping the smallest drum, the gripping pin is positioned at a distance D' above the floor plane and in the position B" for gripping the largest drum at a distance D" above the floor plane.

The support frame of the winding machine supports vertically displaceably a rotation apparatus 10 for the drum. The rotation apparatus comprises a motor-operated drive wheel 11 arranged to be pressed against the peripheral edge of the drum flange. The rotation apparatus will be described in greater detail in connection with FIG. 1, in which it is shown as detached from the rest of the winding machine for the sake of clarity.

A pulse generator 12 is positioned in one of the carriers in the vicinity of the vertical adjusting screw of the gripping pin. The pulse generator 12 detects each revolution of the adjusting screw when the gripping pin is adjusted to the gripping position. The pulse generator is connected by means of a conductor 13 to a calculator 14 which receives the pulses from the pulse generator. The calculator in turn is connected to a programmable control means or device 15.

The drive wheel 11 of the rotation apparatus and a motor 16 are mounted on a base 17 mounted vertically movably on a carriage 18 which is supported by the support frame of the winding machine. The carriage is connected to an adjusting screw 19 operated by a motor 20 supported stationary by the support frame 1 of the winding machine. A compressed-air bellows 21 is mounted between the base of the drive wheel and a shoulder formed in the carriage, and the bellows in turn is connected by means of a conductor 22 to a source of compressed air 23. An air pressure regulator 24 connected by means of a conductor 25 to the control device 15 is coupled to the conductor 22. The motor 20 of the adjusting screw 19 is also connected by means of a conductor 26 to the control device 15.

The winding machine operates in the following way.

When the winding machine is to pick up a drum, the adjusting screw motor 7 of each gripping pin 5 receives a pulse from the actuating system of the winding machine to rotate the adjusting screws, so that the gripping pins are displaced downwards from the upper winding position A. After the gripping pins have reached the central openings of the drum flanges, i.e. the gripping position B' or B", the motors of the adjusting screws stop and the gripping pins are inserted into the central openings. During the downward movement of the gripping pins, the pulse generator 12 applies a number of electronic pulses to the calculator 14, the number of the pulses corresponding to the number of revolutions accomplished by the adjusting screw. The number of revolutions of the adjusting screw corresponds to the distance over which the gripping pin has moved downwards from the winding position, that is, to which height above the floor plane the gripping pin has been displaced. The distance D above the floor plane 9 in the gripping position of the gripping pins gives accurate information on the radius of the flange of the cable drum.

The calculator sends a signal corresponding to the total number of pulses from the pulse generator to the programmable control device 15. The control device calculates a first control signal for the adjusting screw motor 20 of the drive wheel, and a second control signal for the air pressure regulator 24 of the drive wheel. The first control signal is sent through the conductor 26 to the adjusting screw motor so as to rotate the adjusting screw 19 by means of the motor to such an extent that the distance between the periphery of the drive wheel and the winding position A of the gripping pins equals the radius of the flange of the drum. The drive wheel is thus positioned against the peripheral edge of the drum flange when the drum is lifted to the winding position. The second control signal is sent through the conductor 25 to the air pressure regulator 24 so as to regulate the air pressure to a value such that the pressure in the bellows 21 presses the drive wheel with a predetermined force programmed in the control device for each particular drum size and material. In this way, the first control signal enables a rough adjustment of the drive wheel to a desired operating position, while the second control signal enables a fine adjustment of the pressure of the drive wheel in the operating position. One suitable air pressure regulator is a FESTO regulator, type MPP3; a suitable compressed-air bellows is a FIRESTONE AIRSTROKE bellows, type 1909; and a suitable programmable analog control device is a SIEMENS SIMATIC apparatus S115 including an analog output and calculator.

By means of the arrangement according to the invention, the size of the flange of the winding drum can be detected reliably, and the operating position of the drive wheel as well as the pressing force of the drive wheel can be adjusted correspondingly on the basis of the detected drum size.

The drawings and the description related to them are only intended to illustrate the idea of the invention. In its details, the arrangement according to the invention can vary within the scope of the claims. The power means of the gripping pins can equally well be operated by pressure fluid, e.g. a pneumatic cylinder with a reading device for the movement of the piston rod (FESTO double-acting cylinder, type DKE-PPV-A) or a hydraulic cylinder can be used, whereby a suitable detecting means in both cases is a linear pulse generator.

I claim:

1. In a winding machine for winding and unwinding a cable on or from a flanged drum, said machine having a support frame, two gripping pins, each vertically displaceable in the support frame and arranged to coaxially grip one flange of the drum, power means for vertically displacing the gripping pins between a lower gripping position and a fixed upper winding position to lift the drum off of a floor plane, said lower position varying in accordance with the diameter of the flange of the drum, and rotating means supported by the support frame for rotating the drum, said rotating means comprising a rotatable and displaceable drive wheel, adjusting means for moving the drive wheel to an operating position against the flange of the drum and pressure means for pressing the drive wheel against the flange of the drum; the improvement comprising, a detecting device for determining the vertical distance of at least one of the gripping pins from the floor plane when it is in its lower gripping position for axially gripping the drum as an indication of the diameter of the flange of the drum and control means responsive to said distance determined by the detecting device for activating, based on the diameter of the drum's flange, both the adjusting means of the drive wheel to move the drive wheel to an appropriate operating position against the flange of the drum, and the pressure means to regulate the pressure of the drive wheel against the flange of the drum with a force related to the diameter of the drum's flange.

2. The machine of claim 1, wherein the detecting device determines the vertical distance between the gripping pin's fixed upper winding position and its lower gripping position as it grips the drum as an indication of the diameter of the flange of the drum.

3. The machine of claim 1 or 2, wherein the power means for vertically displacing the gripping pins between the gripping position and the winding position comprises a motor-operated adjusting screw and the detecting device is a pulse generator responsive to revolutions of said adjusting screw.

4. The machine of claim 1 or 2, wherein the power means for vertically displacing the gripping pins between the gripping position and the winding position comprises a pressure fluid operated cylinder and the detecting device is a linear pulse generator.

5. The machine of claim 1, including regulating means for regulating the pressure exerted by the pressure means on the drive wheel, said regulating means being controlled by the control means based on the diameter of the drum's flange.

6. The machine of claim 5, wherein the pressure means is pressure fluid operated and the regulating means is a pressure fluid regulator.

7. The machine of claim 1, wherein the control means is a programmable logic control device and the detecting device is connected to said control device.

* * * * *